US005398893A

United States Patent [19]

Barker et al.

[11] Patent Number: 5,398,893

[45] Date of Patent: Mar. 21, 1995

[54] MODEL AIRCRAFT CONSTRUCTED WITH EXTRUDED FLUTED PLASTIC SHEET

[76] Inventors: George S. Barker, 3009 Wundham, Richardson, Tex. 75082; Lawrence H. Ragan, 1307 Chesterton, Richardson, Tex. 75080-2802

[21] Appl. No.: 215,410

[22] Filed: Mar. 18, 1994

Related U.S. Application Data

[63] Continuation of Ser. No. 740,491, Aug. 5, 1991, abandoned.

[51] Int. Cl.[6] ..... B64C 3/50; B64C 3/26

[52] U.S. Cl. ..... 244/215; 244/123; 16/225

[58] Field of Search ..... 244/213–215, 244/219, 123, 133, 87; 16/225, DIG. 13

[56] References Cited

U.S. PATENT DOCUMENTS 4,230,295 10/1980 Eppler ..... 244/213
4,563,381 1/1986 Woodland ..... 16/225
4,598,889 7/1986 Remington ..... 244/87
4,670,938 6/1987 Fowlstan ..... 16/225
5,115,855 5/1992 Lindblom et al. ..... 16/225

OTHER PUBLICATIONS

Coro Star 40, U.S. Air Core Publication Nov. 4, 1991.
"Cub Instructions" Carl Goldberg Models Inc Chicago Ill. 60651.
"Gentle Lady", Carl Goldberg Models Inc Chicago Ill. 60651.
Sig 1989 Catalog #51, Montezuma, Iowa.

*Primary Examiner*—Galen L. Barefoot
*Attorney, Agent, or Firm*—Jones, Day, Reavis & Pogue

[57] ABSTRACT

Aircraft components utilize flexible fluted extruded twin wall plastic sheet to form aileron hinges, horizontal stabilizers and elevators, vertical stabilizers and rudders, compound landing gear, struts, and control systems which are lighter in weight and lower in cost than previously available structures. The landing gear has damping characteristics superior to previous gear. The invention is particularly well suited to remotely controlled flying model aircraft.

10 Claims, 3 Drawing Sheets

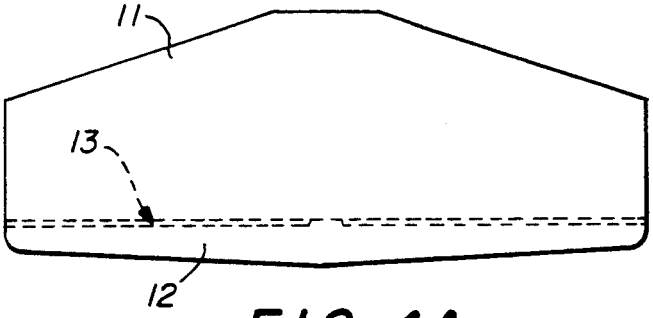
FIG. 4A
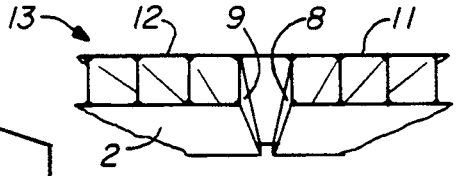
FIG. 4B
FIG. 5B
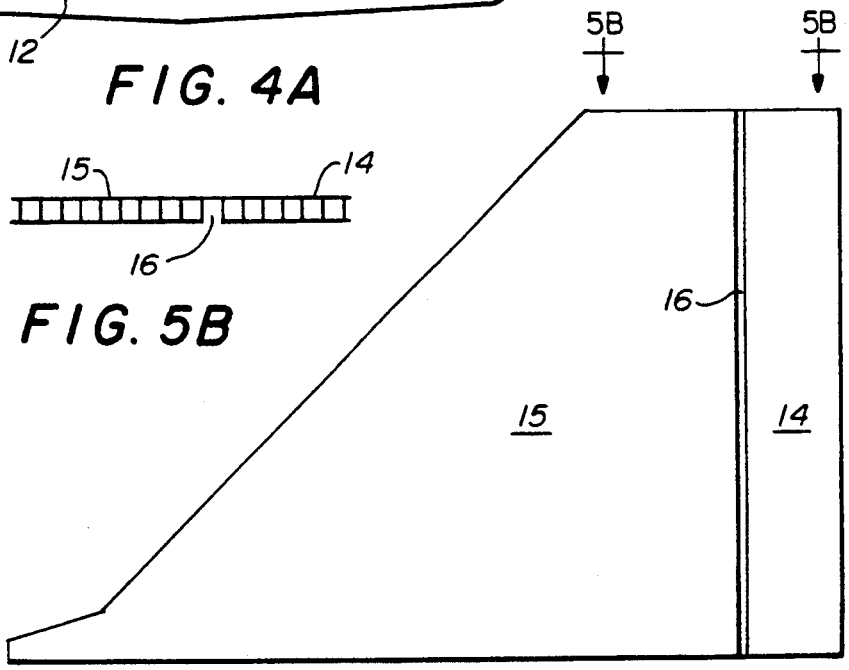
FIG. 5A
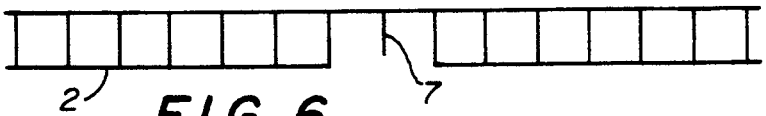
FIG. 6
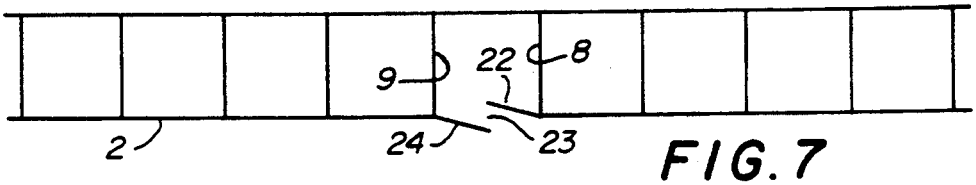
FIG. 7
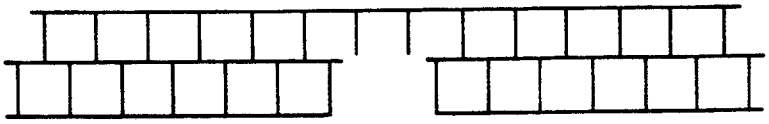
FIG. 8

MODEL AIRCRAFT CONSTRUCTED WITH EXTRUDED FLUTED PLASTIC SHEET

This is a continuation of application Ser. No. 07/740,491, filed on Aug. 5, 1991, now abandoned.

BACKGROUND OF THE INVENTION

1. Field of the Invention

This invention relates in general to aircraft and in particular to model aircraft components constructed with twin wall fluted plastic sheet material.

2. Description of Prior Art

In order to provide background information so that the invention may be completely understood and appreciated in its proper context, reference may be made to a number of prior art publications as follows:

1) Cub Instructions, Carl Goldberg Models 4734 W. Chicago Ave, Chicago, Ill. 60651 pub 2077 1-585.
2) CoroStar 40 Construction Manual U.S. AirCore 4576 Clair Chennault, Hangar 7, Dallas Tex., 75248 Part Number USA11141.
3) Sig Catalog #51 Sig Manufacturing Company, Inc. 401-7 Front St., Montezuma Iowa 50171
4) Gentle Lady Instructions. Carl Goldberg Models 4734 W. Chicago Ave, Chicago Ill. 60651 pub 2-680

Model aircraft have traditionally been constructed of lightweight wood (such as balsa) used to form a frame, covered with a film which forms the skin (Ref 1). Recent models have been constructed of vacuum formed plastic sheet laminated over foamed plastic cores. More recent models have been constructed of extruded twin wall fluted plastic sheet. (Ref 2), This material is extruded of various plastic compounds. Polypropylene based compounds have been most effective in that they can be formulated to provide a material which is stiff enough to form airfoils, fuselages, and flight control surfaces, and remain flexible enough to absorb most crashes without exceeding the elastic limit of the material, thus avoiding permanent damage.

Construction of model aircraft with twin wall fluted plastic sheet is much less tedious than construction with wooden frame and sheet skin, and results in models which are much more durable than those constructed by other methods. Twin wall fluted plastic sheet construction presents some unique problems. Traditional hinges of thin plastic sheet or leaf and pin construction (Ref 3 p 92) can be used for control surfaces, but are no easier to install in these new aircraft than in those of traditional construction. Model aircraft hinges have also been constructed from heat shrinkable plastic film covering material which forms the skin of model aircraft with traditional wood frames (Ref 4 p10). These hinges have the advantage of being continuous along the entire length of the control surface, and low in marginal cost, since they are typically constructed of excess covering material. Continuous hinges exhibit less drag than multiple hinges due to the smoothed airflow from the fixed surface over the control surface. Twin wall fluted plastic sheet for model aircraft is not a suitable surface for bonding heat shrinkable film covering material, since the temperatures required exceed the softening point of the polypropylene. A continuous hinge suitable for model aircraft constructed with twin wall fluted plastic sheet is needed.

Early control systems for aircraft provided for distorting or warping wings or other flight surfaces to effect changes in aircraft attitude. There techniques were quickly replaced with separate control surfaces hinged to fixed flight surfaces, since hinged surfaces provided more precise and stable control systems. Until the present invention, the control surface was a separate and distinct piece from its accompanying fixed flight surface, requiring construction of multiple pieces which were joined with hinges. Construction from a single piece, yet resulting in an independent, hinged control surface had yet to be achieved.

Landing gear of model aircraft have, in the past, been constructed of two pieces of spring steel (Ref 1) and affixed to the model's fuselage. The vertical portion of the gear is inserted into slots or holes in the fuselage to provide longitudinal stability to the gear. Aircraft constructed of twin wall fluted sheet require slots or holes in added wooden parts to accommodate these vertical portions of the gear in order to prevent tearing the plastic during hard landings. Another method of providing longitudinal stability is needed.

Another traditional landing gear is made of flat material (Reference 3, page 58). This gear is made of sheet metal or molded plastic. It provides longitudinal stability with its wide mounting surface, and spring action from the material of construction. It is typically heavier and more expensive than landing gear made from formed spring wire.

Both wire and flat gear have another shortcoming, in that they provide no damping. Gear constructed of concentric cylinders, fluids, and controlled orifices provide damping through viscous friction, but are expensive to construct. Damping in the landing gear prevents the aircraft from bouncing as a result of hard landing. It is much easier to control the path of an aircraft if initial contact with the landing surface is not interrupted by bouncing.

Biplanes must have a method to secure the two wings at the proper angles to the fuselage and tail surfaces, provide the proper separation between the wings, and, in replications of early biplanes, provide clearance from the top of the fuselage to the bottom of the top wing. Traditionally, wooden frame members and wires have performed this function. It is tedious to construct model aircraft in this manner. Since models made with extruded fluted plastic sheet typically have little or no internal structure, simple struts are needed for these biplanes. Similarly, monoplanes with wing elevated from the fuselage require struts to attach the wing to the fuselage. Struts which attach wings to fuselages are sometimes referred to as cabanes. We use the term "strut" to include both functions.

Electro-mechanical actuators, known as "servos" for radio controlled model aircraft are typically mounted near the center of the model for reasons of balance. If, for example, the servos which control the rudder and elevator were mounted in the tail, additional weight would need to be added to the nose for proper balance. A lightweight mechanical linkage, or "pushrod" is required to transfer force and motion from servos to control surfaces. Likewise, in a control line aircraft, a linkage is required from the center of pull, near the center of the wing, to the elevator. Pushrods are often fabricated from lightweight wood, wire, and string as shown in Reference 1. More recently, pushrod assemblies, consisting of an outer sleeve which houses an inner rod have been manufactured by various suppliers. One such example is shown in Reference 3, page 101 or 152. A lower cost, lighter weight pushrod system is needed for aircraft constructed from fluted plastic sheet.

Whatever the precise merits, features and advantages of the above cited references, none of them achieves or fulfills the purposes of the aircraft components of the present invention.

SUMMARY OF THE INVENTION

Accordingly, it is a principal object of the present invention to provide aircraft components which are simpler to construct.

It is another principal object of the present invention to provide aircraft components which are lower in cost.

It is a further object of the present invention to provide a continuous hinge suitable for incorporation in an aircraft constructed of twin wall fluted plastic sheet. It is a further object to provide hinged control surfaces and fixed flight surfaces from a single structure. It is a further object to provide lighter weight landing gear with damping. It is a further object to provide struts and pushrods with reduced weight and cost.

In fulfillment and implementation of the above stated objects, the present invention is aircraft components constructed from twin wall fluted plastic sheet. Hinges and landing gear are made of twin wall fluted sheet with a separation in one wall between adjacent webs of the sheet. In the hinge, the separation is cut so as to remove substantially all the wall between the webs. Fixed flight surfaces and moveable control surfaces are constructed from the same piece of twin wall fluted plastic sheet by separating one wall along the desired hinge line, leaving the opposite wall to flex as the hinge between the two surfaces. Either or both surfaces can be stiffened by inserting stiffer material such as wood or wire in one or more of the flutes. In the landing gear, the separation need only be wide enough to admit a wire gear spring. The flat sheet provides longitudinal stability and damping for the gear, while the spring provides resilience. In the preferred implementation, the wire is held in place with an additional sheet of plastic glued over the separation. Struts are made with stiffening members, such as steel wires, inserted in flutes of the sheet material. Pushrods are constructed using the fluted material as guides for lightweight rods of steel wire, plastic, or wood. In the preferred embodiment, the fluted material is part of the aircraft structure, so its function as a pushrod guide is achieved with no increase in weight or cost.

BRIEF DESCRIPTION OF THE DRAWINGS

FIG. 1 depicts the hinge.

FIG. 2 shows use of the hinge strip of FIG. 1*b* in an aileron assembly.

FIG. 2*a* is an end view of the aileron assembled on the hinge, while

FIG. 3 shows construction of landing gear using twin wall sheet and spring steel wire.

FIG. 4 shows the inclusion of a hinge in a preferred tail surface assembly, where horizontal stabilizer, elevator, and hinge are manufactured from a single piece of twin wall sheet.

FIG. 4*a* is a plan view of the tail surface.

FIG. 4*b* is a perspective end view showing the hinge portion.

FIG. 5*a* is a plan view of a similarly constructed vertical fin, hinge, and rudder assembly.

FIG. 5*b* is a cross section showing the hinge portion.

FIG. 6 is a cross section view of a hinge designed for greater range of movement.

FIG. 7 is a cross section view of another embodiment of the hinge where the wall material is left is place.

FIG. 8 is a cross section view of a similar hinge made from fluted material with three walls instead of 2.

FIG. 9 shows construction of one embodiment of the struts.

FIG. 10 shows use of flute as a guide for control pushrods.

DETAILED DESCRIPTION OF PREFERRED EMBODIMENTS

Figure 1A:
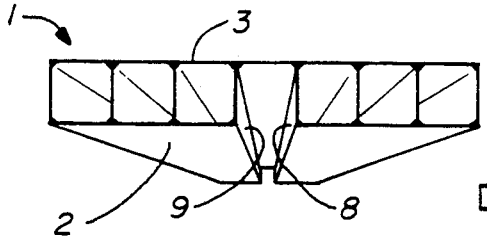
FIG. 1*a* is an end perspective view showing a hinge made by removing one wall between adjacent webs.
Figure 1B:
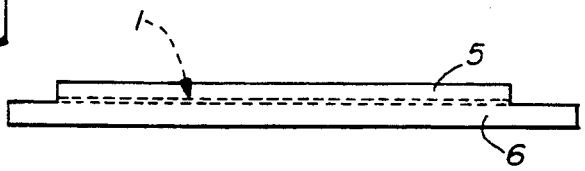
FIG. 1*b* is a plan view of a typical hinge for use in an aileron of an airplane.

Manufacture of the aircraft components begins with twin wall plastic sheet. The manufacture of such sheet is well known, and not a subject of the present invention. The nature of twin wall plastic sheet is shown in FIG. 1*a*) The walls are the outside flat surfaces of the material. (In multiple wall plastic sheet with more than two walls, at least one of the surfaces called walls will not be have an outside surface). Webs are the joining structures between the walls. The long hollow spaces enclosed by two walls and two webs are called flutes. Notice that walls are parallel and webs are parallel. In the figure, webs are shown perpendicular to walls. Depending on a number of manufacturing variables, the webs may intersect the walls at angles other than 90 degrees. Manufacture of the various components proceeds as follows:

Twin wall plastic sheet is selected from the variety of thicknesses and materials available to provide the proper flexibility, strength, and size for the required hinge 1. The thickness and material composition of wall 2 determine the flexibility and strength of the resulting hinge 1. The material is then cut to the proper length and width as required for the finished hinge 1, suing steel rule dies. Notice that leaf 5 and leaf 6 are of different length as shown in FIG. 1*b*. They could, of course, be the same length. The final step in manufacturing hinge 1 is to create a separation in wall 2 of the twin wall along flute 7 between web 8 and web 9. This can be accomplished in a number of ways, including a steel rule die and cutting with a hand knife. The portion of wall 3 then remaining between web 8 and web 9 is then free to flex, forming the hinge. Notice that the axis of the hinge is parallel to the walls and webs of the material.

Figure 2A:
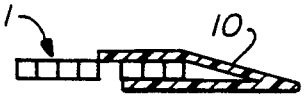
Figure 2B:
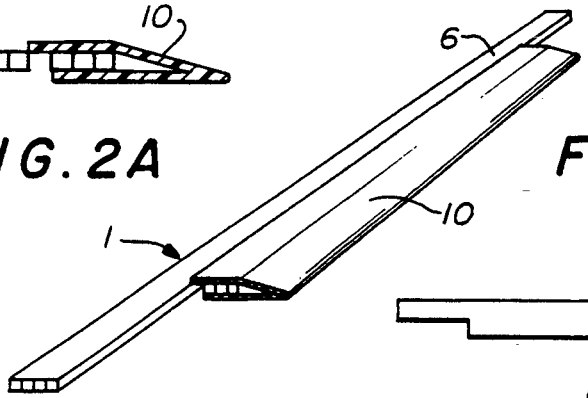
FIG. 2*b* is a perspective of the same assembly.
Figure 2C:
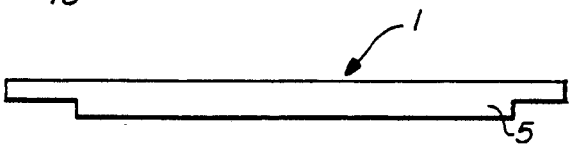
FIG. 2*c* is a plan view of the assembly

A typical application of the hinge is shown in FIG. 2, where aileron 10 is attached to leaf 5 on two sides with glue. Leaf 6 is then glued between the top and bottom skin portions of an aircraft wing along the trailing edge. Leaf 6 then serves to stiffen the trailing edge of the wing and support the hinge and aileron in the proper position.

Inclusion of the hinge in a tail surface assembly is shown in FIG. 4. A piece of twin wall plastic material is cut to the proper shape to form a horizontal stabilizer and elevator using a steel rule die. A hinge is created by cutting away a portion of the appropriate wall 2 between web 8 and web 9 for the entire width of the piece, thus forming a horizontal stabilizer 11, elevator 12, and hinge 13 from one piece of material. A similar application is shown in FIG. 5, where a rudder 14 and vertical stabilizer 15 joined by hinge 16, are formed from a single piece of twin wall sheet in the same manner.

It is not necessary to remove all of wall 1 between web 8 and web 9 to fabricate hinge 1. The amount of material removed, along with the dimensions of the webs and flutes, will determine the limit of range of free movement of hinge 12. The limit of travel of the hinge 1 is limited to the point where web 8 touches web 9. The travel arc of the hinge can be increased by removing, two or more adjacent sections of wall 2, as shown in FIG. 6. In such hinges it may be advantageous to remove the intervening web 7 for additional flexibility. In this case, the hinge is two flutes wide instead of one. Likewise, if it were desired to construct hinges from material having three or more walls, one could remove portions or all of webs and interior walls as necessary, leaving only wall 3 to flex as a hinge, as shown in FIG. 8, with travel determined by the amount of material removed. This invention is not limited to a particular number of sections of walls or intervening webs which are removed.

Another variation of the hinge is shown in FIG. 7. Here the separation in wall 2 is a single slit, and no material is removed. Flap 22, consisting of the material of wall 2 between slit 23 and web 8, is permanently distorted so it slides inside flap 24, which consists of the material between slit 23 and web 9.

The hinge is not limited in application to aircraft. Persons of skill and imagination will undoubtedly find applications in cabinetry, shipping cases, outdoor shelters, and other equipment and fixtures.

Figure 3A:
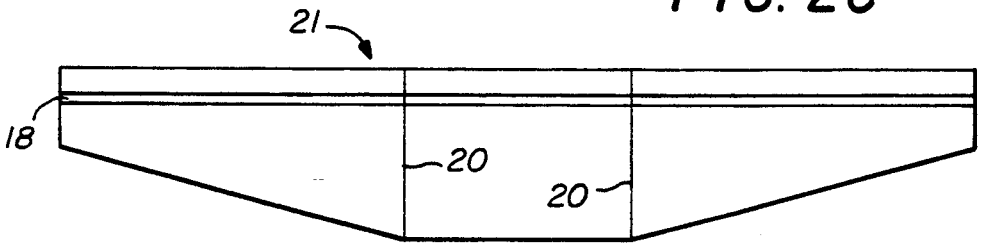
FIG. 3*a* is a bottom view of the flexible fluted material piece showing access to a flute for the spring.
Figure 3C:
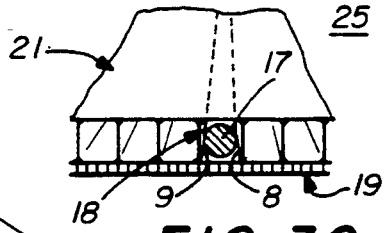
FIG. 3*c* is an end perspective view of a section of the landing gear showing the spring in place.
Figure 3B:
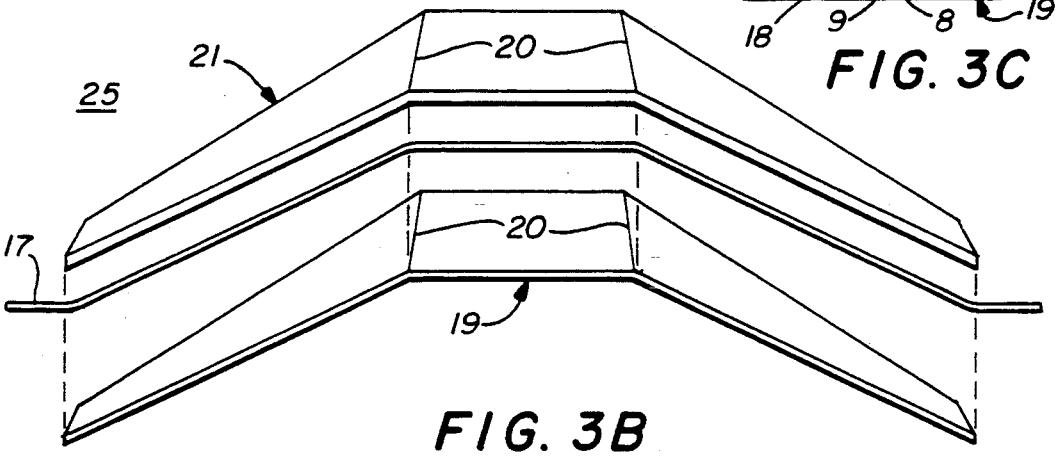
FIG. 3*b* is an exploded view of the assembly of the landing gear.
Figure 9A:
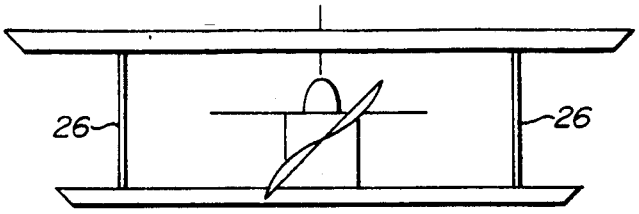
FIGS. 9*a* & 9*b* are front and side views of biplane aircraft showing typical strut placement.
Figure 9B:
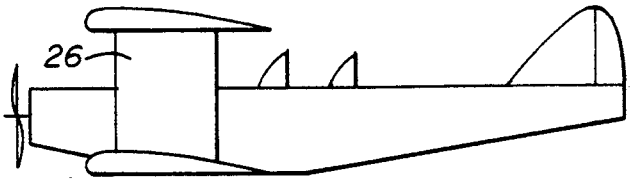
Figure 9C:
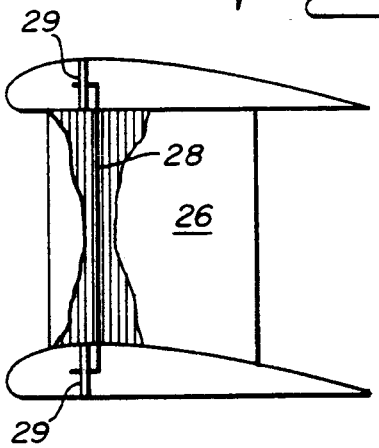
FIG. 9*c* is a side cutaway view showing details of a strut constructed from fluted material and wire.
Figure 10A:
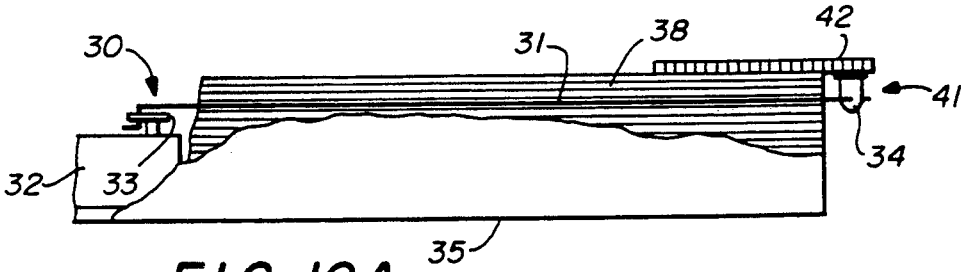
FIG. 10*a* is a cutaway side view of a fuselage showing the control wire in place in a flute in the side structure of the fuselage.
Figure 10B:
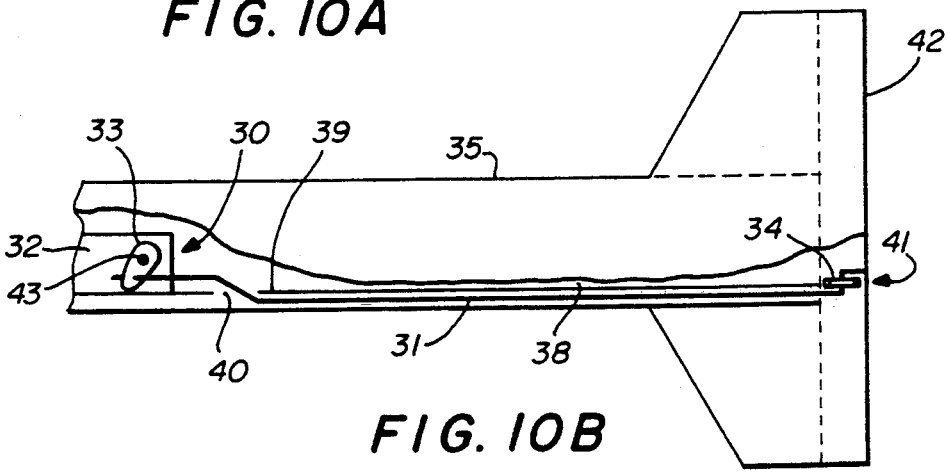
FIG. 10*b* is a cutaway top view of the same control system.

Construction of landing gear 25 is illustrated in FIG. 3. Twin wall flexible plastic sheet is selected for proper strength and stiffness to prevent landing gear wire 17 from rotating fore and aft during takeoff or landing of the aircraft. The piece 21 is then cut to the desired shape with a steel rule die. It may also be scored along the bend lines 20 to facilitate a small radius bend. If the twin wall sheet piece is formed by cutting with a steel rule die, the scores along bend lines 20 can be formed in the same cutting operation by use of blunt blades. A separation in wall 2 is formed along the length of the twin wall sheet piece by cutting, with a hand knife or other method, wall 2 between web 8 and web 9 along the length of flute 18 in piece 21. Then spring steel wire 17 is positioned in flute 18 between web 8 and web 9 through the separation in wall 2. Retaining sheet 19 completes the assembly when glued over wall 2, thus capturing wire 17 inside the finished assembly. The finished landing gear can then be attached to the aircraft with bolts through piece 21 and the bottom of the aircraft, or with other attachment methods such as rubber bands.

The resulting compound landing gear 25 has advantages over landing gear of the same basic shape made of single materials such as spring steel, spring aluminum, fiberglass, or plastic. It weighs less than plastic gear of similar size and shape. The spring steel wire provides the resilience, and the twin wall plastic sheet provides damping in the new compound gear. Aircraft fitted with damped gear exhibit a reduced bounce height in a landing with excess vertical speed. The transition from flight to ground handling is thus much smoother, resulting in more positive control of the attitude and path of the aircraft.

It is not necessary for retaining sheet 19 to completely cover wall 2 of piece 21. In the preferred embodiment shown in FIG. 3, the size of sheet 19 is chosen for esthetic reasons. Sheet 19 can be attached with screws, brads, rivets, or attachment methods other than adhesives. Sheet 19 is not necessary in all gear configurations. Steel wire 17 can be held in place with flexible adhesives such as Room Temperature Vulcanizing rubber (RTV). If wall 2 is only slit to form the separation between web 8 and web 9, (no material of wall 2 is removed), it can be reformed with various glues. With certain shapes of landing gear, wire 17 can be inserted from the end of flute 18 without separating wall 2. This invention is not limited as to method of placing or retaining wire 17 in flute 18.

Of course, it is not necessary to remove material in walls or webs for hinges or landing gear if the flexible fluted material is fabricated without the undesired material in place. This can be accomplished by design or modification of the extrusion die which forms the flexible fluted material.

Struts 26 are manufactured by cutting flexible fluted plastic sheet, of the proper cross section to the desired plan shape 27 using steel rule dies. Steel wire 28 is then inserted in a chose flute extending through piece 27 into the wings or fuselage. Wire 28 is then bent 90 degrees and secured through holes in spars 29 to hold the wings together. Wire 28 can be secured in the wings or fuselage with traditional methods such as bends in the wire, collars and screws, or threads cut in the wire and nuts and washers. Other structural members, such as ribs, rails, or formers, can be used to secure wire 28. In some installations, wire 28 can be a tension member. In these cases, wire 28 can be multistrand cable, monofilament line, dental floss, or even cotton string. The invention is not limited by the material of the wire, attachment member or attachment method.

Pushrod control 30 is constructed using an existing flute 38 in the side of fuselage 35 through which wire 31 is inserted. Prior to insertion in flute 38, a double bend 36 is created in wire 31 to provide motional clearance from the inside wall 39 of fuselage 35. Double bend 36 is typically created using a conventional bending jig. Wire 31 is connected to control arm 33 of servo 32 using double bend 37. Separation 40, in flute 38 along inside wall 39 is cut using a hobby knife. Wire 31 is then inserted into flute 38 through separation 39. Next, double bend 41 is formed in wire 39 and elevator control horn 34 is installed on wire 39. Finally, control horn 34 is glued to elevator 42, and servo control horn 33 is installed on servo 32 using screw 43, thus motion of servo arm 33 is transferred to elevator 42.

Flute 38 can be in either side, top, or bottom walls of fuselage 36. Flute 38 might be part of an internal fuselage structure, such as longerons. Wire 31 might be constructed of plastic, or be a compound structure of plastic tube and steel wire end pieces. If pulleys are used instead of control horns, Wire 31 can be in tension, and can therefor be stranded cable, monofilament line, dental floss, or even cotton string. In such cases, use of two flutes for each control may be advantageous to avoid tanging. Attachment of wire 31 to control horns 33 or 34 could be done with plastic or steel clevises, as shown in Reference 3, page 156, with ball links, as shown in Reference 3, page 157, or with sliding "keepers", as shown in Reference 3, page 97. In full scale aircraft, pedals, sticks, and other human operated devices may be used in place of servos. Rudders, ailerons, or other control surfaces can be similarly controlled. The invention is not limited by selection of flute, material of the force transfer member, attachment method, size or actuation method of the control input, or specific control surface.

Fluted flexible material can be cut with many methods other than the steel rule die technique mentioned. A hand knife is just one example. A hot wire or blade technique is another. The invention is not limited to cutting method.

Although references have been made in the descriptions to "model" aircraft, all the devices described are applicable to aircraft of any scale, including full scale or conventional aircraft.

Methods of constructing hinges, landing gear, struts, and control systems for aircraft have been described in detail in the above text and accompanying drawings. These components are lower in cost and lighter in weight than previously available. Additionally, the landing gear has damping characteristics superior to previous gear.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

We claim:

1. An aircraft control mechanism comprising:

an aircraft lift element comprising at least first and second spaced substantially parallel flexible walls connected to each other by a plurality of spaced webs and having a leading edge and a trailing edge;

an aircraft control element in spaced relationship with the trailing edge of said lift element and comprising at least corresponding first and second spaced substantially parallel flexible walls connected to each other by a plurality of spaced webs; and a flexible hinge coupling said control element to the trailing edge of said lift element, said hinge comprising a flexible wall integrally formed with said first wall of said lift element and said first wall of said control element such that a single continuous wall forms said first wall of said lift element, said first wall of said control element and said flexible hinge wall so as to enable said hinge wall to flex and allow arcuate movement of said control element with respect to said lift element.

2. An aircraft control mechanism as in claim 1 wherein:

said lift element is an aircraft wing; and said control element is an aircraft aileron.

3. An aircraft control mechanism as in claim 1 wherein:

said lift element is an aircraft horizontal stabilizer; and said control element is an aircraft elevator.

4. An aircraft control mechanism as in claim 1 wherein:

said lift element is an aircraft vertical stabilizer; and said control element is an aircraft rudder.

5. An aircraft control mechanism as in claim 1 wherein said lift element and said control element comprises:

extruded plastic sheets forming spaced walls; and extruded plastic forming said spaced webs connecting said spaced walls.

6. An aircraft control mechanism as in claim 1 wherein said flexible hinge wall is adhesively attached to said lift element and said control element to form said single continuous wall.

7. A method of forming an aircraft control mechanism comprising the steps of:

forming an aircraft lift surface having first and second spaced flexible walls and a leading edge and a trailing edge;

interposing a plurality of spaced longitudinal web structures between said spaced flexible walls to provide rigidity to the aircraft lift surface; and severing one of said walls between two of the spaced longitudinal web structures such that a lift surface and a control surface are formed with the nonsevered one of said walls forming a flexible hinge therebetween to allow arcuate movement of said control surface with respect to said lift surface.

8. A method as in claim 7 further comprising the steps of:

forming an aircraft wing with said lift surface; and forming an aircraft aileron with said control surface when said one of said walls is severed.

9. A method as in claim 7 further comprising the steps of:

forming an aircraft horizontal stabilizer with said lift surface; and forming an aircraft elevator with said control surface when said one of said walls is severed.

10. A method as in claim 7 further comprising the steps of:

forming an aircraft vertical stabilizer with said lift surface; and forming an aircraft rudder with said control surface when said one of said walls is severed.

* * * * *